United States Patent [19]

James

[11] 4,108,455

[45] Aug. 22, 1978

[54] CARGO PALLET INCORPORATING RETRACTABLE BALL UNITS

[75] Inventor: Varnell L. James, Kent, Wash.

[73] Assignee: The Boeing Company, Seattle, Wash.

[21] Appl. No.: 642,748

[22] Filed: Dec. 22, 1975

[51] Int. Cl.[2] ..... B62D 21/18

[52] U.S. Cl. ..... 280/43.23; 16/26; 16/33; 254/2 R; 280/43.24

[58] Field of Search ..... 280/43.22, 43.23, 43.12, 280/43, 43.24; 16/25, 26, 32, 33; 254/2 R, 2 B, 2 C; 108/51.1; 193/37

[56] References Cited

U.S. PATENT DOCUMENTS

| | | | |
|---|---|---|---|
| 1,391,363 | 9/1921 | Bozik | 16/26 |
| 1,440,641 | 1/1923 | Stevens | 16/26 |
| 1,892,406 | 12/1932 | Meyercord et al. | 280/43.23 |
| 2,671,242 | 3/1954 | Lewis | 16/33 |
| 2,972,162 | 2/1961 | Townsend | 16/26 |
| 3,361,092 | 1/1968 | Budd | 108/51.1 |
| 3,464,371 | 9/1969 | Gifford | 108/51.1 |
| 3,466,697 | 9/1969 | Cain et al. | 16/26 |
| 3,661,099 | 5/1972 | Shelor | 108/51.1 |
| 3,814,030 | 6/1974 | Morgan | 108/51.1 |
| 3,948,538 | 4/1976 | Hovila | 280/43.23 |

FOREIGN PATENT DOCUMENTS

| | | | |
|---|---|---|---|
| 1,214,874 | 12/1970 | United Kingdom | 16/25 |

*Primary Examiner*—John J. Love
*Assistant Examiner*—Michael J. Forman
*Attorney, Agent, or Firm*—Laurence A. Savage; Bernard A. Donahue

[57] ABSTRACT

A cargo pallet incorporates a plurality of pneumatically extendable and retractable roller means disposed in a lower, deck or floor contacting portion thereof. The roller means are arranged in a pattern to provide equitable load distribution such that, when the roller means are extended, the pallet and any cargo thereon may be easily moved in any horizontal direction; and, when the roller means are retracted, the pallet is immobilized with its lower surface resting substantially flush with a cargo-supporting floor, deck or platform. Inherent load-levelling is accomplished since one or more roller means may be partially retracted to accommodate bumps and uneven portions of the floor, deck or platform over which the pallet is to be moved. The conjoint operation of one or more roller means in the foregoing manner also provides a cushioning or load-distributing action for the pallet and its cargo. A manifold system, including header and conduit means, interconnects all of the roller means with each other and with a source of pneumatic fluid, whereby all of the roller means may be simultaneously extended or retracted as may be desired to raise or lower the pallet with respect to the floor, deck or platform by which it is supported.

12 Claims, 2 Drawing Figures

CARGO PALLET INCORPORATING RETRACTABLE BALL UNITS

BACKGROUND OF THE INVENTION

The present invention relates to cargo pallets of the type used by cargo and freight carrying vehicles; for example, cargo aircraft.

This invention further relates to cargo pallets having, as an integral part thereof, extendable and retractable load bearing roller means to facilitate transportation of pallets within a cargo compartment and movement thereof within the compartment as well as into and out of the compartment.

The transportation of cargo by air is generally accomplished by an aircraft specifically adapted to receive and stow within its cargo hold a plurality of substantially rectangular pallets upon which the cargo is loaded. Such pallets may, but need not necessarily, have vertically extending sidewall portions as a part of their structure. Heretofore, cargo-carrying aircraft embodied within their structures extensive, heavy and complicated equipment and machinery to accommodate both bulk cargo and palletized cargo, and to move such cargo into and out of stowed positions within the cargo holds. Such equipment and machinery typically included drive means, traction means, drive rollers, idler rollers, guide rollers, guides and the like. Accordingly, the initial cost of these extensively equipped aircraft, together with the maintenance and down time, or out-of-service, cost thereof has been substantial. Furthermore, the weight of the built-in equipment and machinery has posed additional disadvantages of "dead" weight when the cargo was volume-limited and reduced net payload when the cargo was weight-limited. In either instance, a cargo-carrying aircraft encumbered by such disadvantages could operate neither as efficiently nor as economically as desired.

Although the idea of incorporating some of the required equipment and machinery within cargo pallets and containers has occurred in the past, it has usually not been implemented for aircraft use because of the structural strength, hence weight, needed in the floors of cargo-carrying aircraft to withstand the concentrated loads imposed by heavy pallet support and suspension systems under the various loads encountered in loading and unloading as well as in flight. The prior art discloses numerous approaches and attempted solutions directed to the aforementioned problems and disadvantages. Broadly, the prior art discloses apparatus intended to simplify, minimize and, where possible, eliminate cargo handling equipment and machinery built into, or carried by, vehicles employed for transportation of cargo and freight. The prior art met these problems and disadvantages with varying degrees of success, but none solved them completely; particularly with respect to aircraft where requirements are somewhat different than those of other vehicles.

SUMMARY OF THE INVENTION

The present invention, therefore, is generally directed to improving the economics and efficiency of transporting cargo by air, and has as an object the provision of a novel cargo pallet for overcoming the above-described disadvantages and drawbacks of prior art apparatus. The cargo pallet according to the present invention permits simplification and substantial elimination of heavy and complicated cargo-handling machinery carried by an aircraft, while providing heretofore unrealized advantages of improved load distribution; that is, the ability of an aircraft to carry more concentrated loads on a given floor structure, or normal loads on a lighter floor structure. More particularly, the pallet according to the present invention incorporates a plurality of pneumatically extendable and retractable roller means disposed within roller units attached to the pallet. The roller units are spaced apart from each other and are independently arranged in such a manner as to be extendable through the lower surface of the pallet, engage the cargo compartment floor and to provide equitable distribution of the weight of the pallet and contents on the floor of an aircraft cargo space or similar platform. The roller units are functionally interconnected with each other and with a source of pressurized pneumatic fluid by manifold and valve means, such that all of the rollers may be simultaneously or sequentially extended or retracted as desired. Each roller is vertically movable within its roller unit between predetermined positions and when extended is resiliently biased conjointly with the other roller to provide a load-levelling or load-sharing function, as for example when the pallet rests upon, or must be moved across, an uneven floor or platform. When extended, the rollers serve as omnidirectional rollers to facilitate the lateral movement or disposition of the pallet over the floor or platform, and when the rollers are retracted, the lower or normal floor-contacting surface of the pallet is substantially flush with the floor or platform upon which it rests. The roller means each preferably incorporate a spherical ball roller element within a piston means extendable downwardly from and retractable into a pallet. The preferred structure includes low friction bearing means permitting free rotation of the spherical roller element and retainer means for maintaining the spherical roller element within the piston.

The invention is described in more detail hereinbelow, with respect to a preferred embodiment thereof and with reference to the hereto attached drawings, in which:

DETAILED DESCRIPTION OF THE INVENTION

Figure 1:
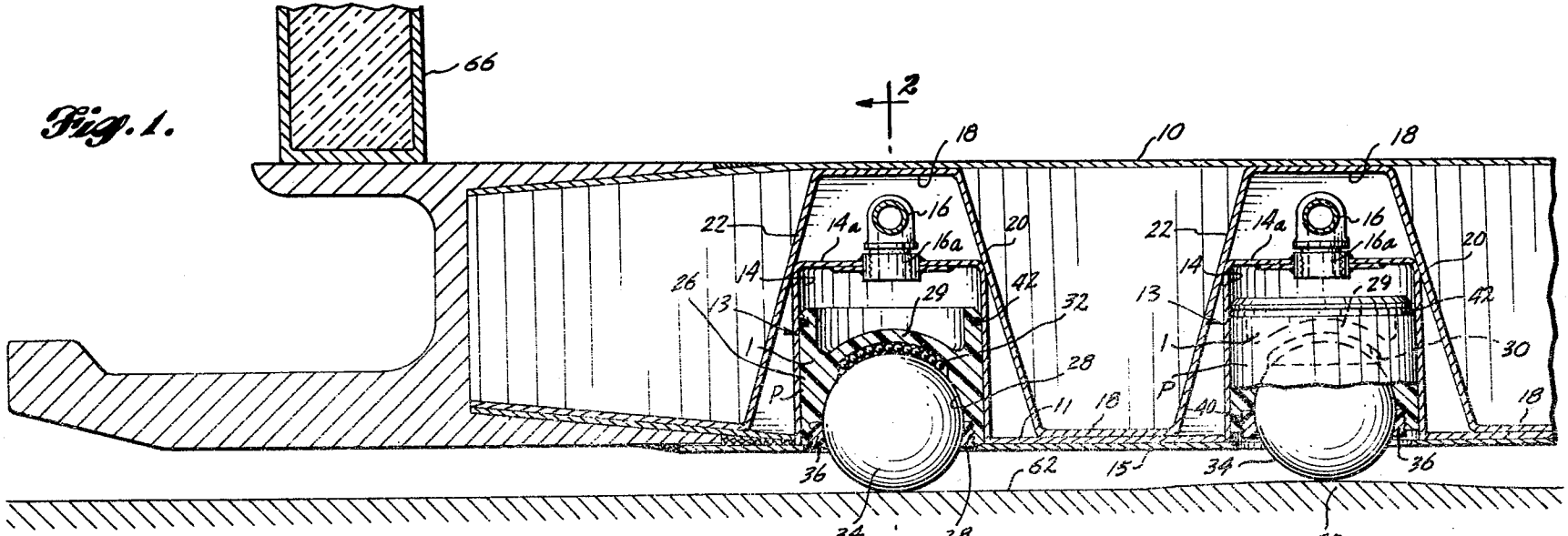
FIG. 1 is a fragmentary longitudinal cross-sectional view of the cargo pallet of FIG. 1 and shows two adjacent roller means with one means fully extended and one means partly retracted to accommodate an uneven deck.

The cargo pallet represented in the drawings is shown resting upon deck 62 and comprises a frame means including top sheet member 10 and an apertured bottom sheet member 11 joined by an intermediate, corrugated member 12. A container side wall 66 is shown attached to the cargo pallet. In longitudinal cross section, the intermediate member, as may best be seen with reference to FIG. 1 is of modified hat section configuration with truncated or flat top and bottom portions 18 joined by slanting or tapered side portions 20. The corrugations are preferably regular, with alternating top and bottom portions 18 thereof equidistantly spaced apart along the top and bottom pallet sheet members 10, 11 respectively. Member 12 is preferably continuous, but may be discontinuous or partly discontinuous as may be necessary to facilitate assembly or construction of the pallet. The material of the pallet top and bottom sheet members, as well as that of the corrugated members, is preferably metal such as aluminum, steel, sheet iron and the like, but may also be glass fiber reinforced plastic, plywood, fiberboard or the like consistent with requirements of strength and stiffness, as is well understood in the pallet construction art. While adequate stiffness in torsion and bending and compression strength is ordinarily provided by the corrugations, additional stiffness and compression strength may be provided for the pallet by filling any unoccupied space between the top and bottom sheet members thereof with expanded plastic foam, light balsa wood or other, similar materials such as cellular honeycomb paper or plastic and the like, as will be understood by one skilled in the art. The thickness of the metal or other materials employed for the pallet top and bottom sheet members and the intermediate corrugated members is chosen for lightness, but must be adequately strong to support the weight of the pallet, together with any cargo placed thereon, without substantial distortion or deformation such as twisting, bending, denting or the like. As will be understood by those skilled in the art, a suitable choice of material thickness may be selected in accordance with well-known design principles. Although it is believed that a cargo pallet constructed in the manner described above is novel, the structural concept of top and bottom sheets separated by corrugations and filler material has been previously disclosed for example in connection with aircraft cabin floor construction.

As may be seen in FIG. 1 of the drawings, the corrugations, in transverse cross section, have straight or vertical end portions 22 extending between top and bottom sheet members 10, 11 of the pallet. It will be noticed that the length of each corrugation, transverse the pallet, is substantially less than the pallet width, such that the tops, bottoms, sides and ends of each corrugation form a closed box or cell; whereby a plurality of cells may be accommodated across the pallet width, as will be hereinafter described in more detail in connection with the ball units contained therein.

A plurality of ball units 13 are arranged in a desired pattern within the pallet and disposed adjacent the bottom sheet member 11 thereof. Each ball unit 13 comprises an outer cylinder 14 normally open at one end and closed at the other end by a cylinder head 14 which is provided with an opening and pressure fitting 16*a*. A manifold system, including conduits 16, distributes pneumatic fluid from a header 17 to each cylinder in the plurality of ball units, and is connected to the cylinders by the aforementioned pressure fittings. Header 17 may be intermittently connected, as desired, to a source of pneumatic fluid, not shown. Suitable valves, also not shown, are employed to alternately connect and disconnect the manifold and header arrangement from the fluid source, as will be understood by one skilled in the art.

Within each cylinder 14 there is disposed a piston P. The piston P has an upper crown portion 24 and a lower, depending skirt portion 26 defining a substantially hemispherical chamber 28. At the upper end of chamber 28 and within the piston crown 29 there is provided an arcuately curved shallow recess 30 having a diamter somewhat greater than that of chamber 28. A plurality of identically dimensioned ball bearings 32 are disposed in intimate rolling contact with each other within recess 30, such that each ball bearing is substantially tangent to the hemispherical chamber 28 but does not protrude into the chamber 28. A spherical roller or ball 34 having a diameter substantially equivalent to chamber 28 is at least partly disposed within chamber 28 and is held snugly but rotatably therein by a ball-retaining ring 36 fastened to piston P as shown. Threads 38 on ring 36 are complemental with threads 40 provided on the inner periphery of the depending skirt portion 26 of piston P. Retaining ring 36 has an inner diameter slightly less than the maximum diameter of ball 34, and the inside wall surface of the ring is complementally curved in an axial direction to match the curve of the ball. Thus, the ball is held within the chamber by the ring, but is permitted to substantially freely rotate by virtue of the ball bearings, the ring shape and the chamber itself.

Piston P is provided with at least one piston ring 42 surrounding the crown portion thereof and carried by a suitable annular groove therein. The piston ring 42 is preferably resilient and continuous in the manner of an "O-ring," but may also be of the discontinuous split-ring type, provided that a fluid-tight seal between the piston P and cylinder 14 is effected. As will be apparent, the arrangement shown and described permits a substantially free, vertically reciprocal motion of the piston within the cylinder; but retains the piston therewithin at all times, as will hereinafter be described.

Figure 2:
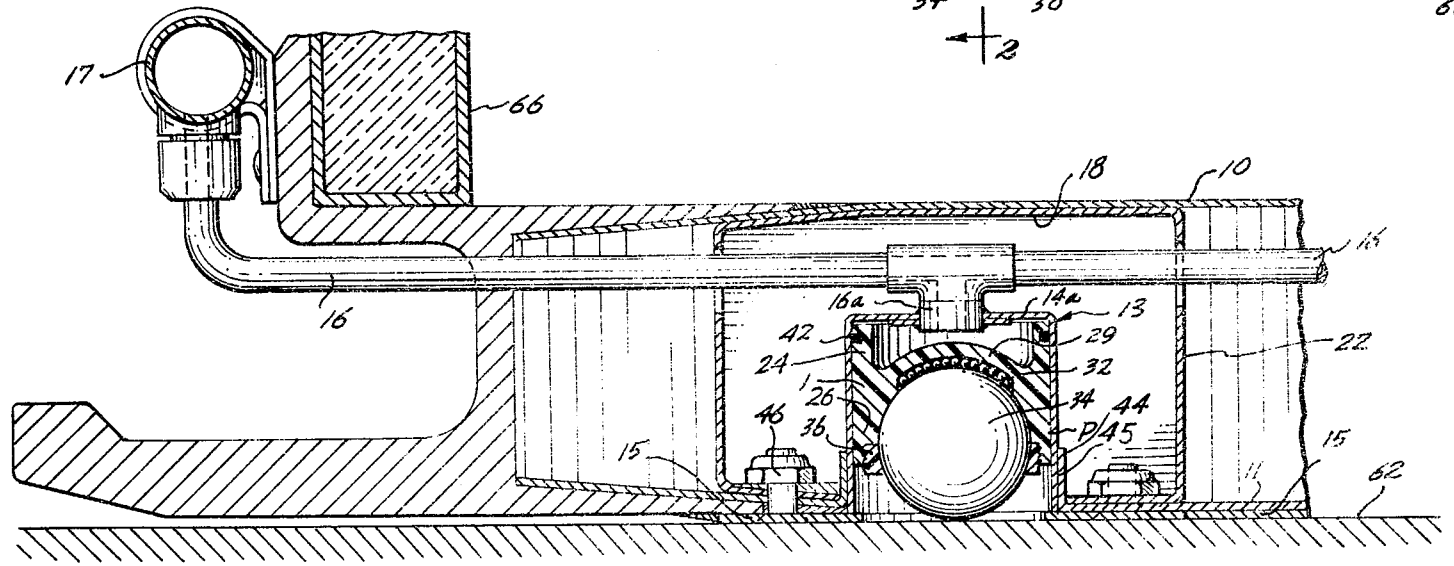
FIG. 2 is a fragmentary transverse cross-sectional view of the cargo pallet of FIG. 1 and shows a roller means fully retracted within the cargo pallet.

Piston P may be biased upwardly by a spring means (not shown) in order to urge the piston and roller means carried thereby into the position shown in FIG. 2.

In order that the piston and ball assembly be securely held within the cylinder at the lower limit of travel or reciprocation of piston P, there is provided an apertured retaining plate 15 disposed adjacent the bottom or normally open end of cylinder 14 and flush with lower sheet member 11 of the pallet base. The apertures within plate 15 correspond in number and location with the apertures in lower sheet member 11 of the pallet, whereby at the lower limit of piston travel, balls 34 may at least partially protrude therethrough. The diameter of each aperture in plate 15 is less than the corresponding diameter of either cylinder 14 of piston P but permits at least a portion of ball 34 to protrude therefrom when piston P is in its extended position.

Each ball unit 13 is arranged within a closed box or cell of corrugated sheet 12 in such a manner that the shoulders of cylinder 14 may, but need not necessarily touch the slanting sidewalls 20 of the closed box or cell, and are free from the endwalls 22 thereof. Each ball unit is held in its position by upturned edges or lips 44 (FIG. 2) of pallet bottom sheet 11 which snugly contact the outer wall surface 45 along at least a portion of cylinder 14. Suitable fastening means 46 are provided to secure retaining plates 15 and the closed boxes or cells in their proper positions with respect to the bottom of the pallet.

The material employed for piston P may be metal or plastic. If plastic, nylon, polytetrafluoroethylene or other strong structural plastics are preferred. If constructed of metal, brass, steel, aluminum or the like may be used. The ball 34 may also be made from metal or plastic, although metal is preferred for its properties of strength, relative incompressibility under load and durability. The piston and ball materials must be selected to minimize galling or binding therebetween, and to facilitate free rotation of the ball within chamber 28. The ball bearings 32 may be made from metal or plastic but are preferably made from metal to provide long life and durability. Ball retaining ring 36 is preferably dimensioned such that it performs a "scraper" action, upon ball 34, preventing dirt and debris from being rotated by the ball into piston chamber 28, and thereby minimizing scouring, binding and abrasion between the walls of the chamber and the surface of the ball. As will be understood by the skilled worker, suitable lubrication may be provided between the external surfaces of the ball and the interior piston wall surfaces of chamber 28, and particularly between the ball bearings. However, if the ball and/or piston are formed from or coated with an elastomer such as polytetrafluoroethylene, for example, a low friction rolling contact between them will be provided and the use of additional lubricants may be minimized.

Each ball unit is connected to a source of pneumatic pressure by means of manifold branches 16, whereby pressurized fluid may be admitted into the space between cylinder head **14*a* and crown 24 of piston P in each roller means. When manifold header 17 is connected to a source of pressurized pneumatic fluid through a valve or valves (not shown) the fluid is transmitted to all cylinders of all ball units simultaneously, forcing all pistons downwardly to the full extent of their travel, which is limited and defined by the piston skirt portions contacting retaining plates 15. Alternatively the various ball units may be extended sequentially, seriatim, or in a predetermined pattern whereby only a portion of the balls are extended or in which a segment of the pallet may be raised to tilt or otherwise manipulate the pallet. When extended each ball in each ball unit protrudes from the bottom surface of the pallet through the apertures in retaining plate 15, thereby suspending the pallet above a deck, cargo floor or platform. When pneumatic fluid is exhausted or withdrawn from cylinders 14** through suitable valve means, the weight of the pallet and its load causes the balls and their pistons to retract or slide upwardly within the cylinders, effectively lowering the pallet until its bottom surface makes substantially flush contact with a cargo bearing floor or deck. From this description it will be understood that, when retracted, the balls allow the pallet to be substantially immobilized on the cargo deck by virtue of friction due to its bottom surface engaging the deck; but, when extended, the balls raise the pallet from the deck and provide substantially friction-free rolling contact thereon, so that the pallet may be easily moved in any lateral direction to facilitate stowage of the same.

An important feature of the present invention as hereinabove described, is the self-levelling or load-sharing function provided by the novel ball units, which function may be better understood with reference to FIG. 1. If the pallet, with balls extended, is required to traverse an uneven or bumpy surface, one or more of the ball units cooperates with adjacent ball units to compensate for the bump. For example, in FIG. 1, the right-hand ball is shown partly retracted, having been forced upwardly within the cylinder by the raised portion 60 of deck 62 against the force transmitted by the pressurized pneumatic fluid between the cylinder head and the piston crown; whereas the left-hand ball remains fully extended. As a consequence, the pallet and its load remains level and is not adversely affected by the uneven, bumpy surface. In this manner, both self-levelling and load-sharing is provided by adjacent ball units acting conjointly with each other against pneumatic pressure equalized by manifold 17.

The well or recess located within the crown of piston P insures that there will always be some amount of cylinder volume available, even when a ball unit is fully retracted. This is desirable when pressure is first applied to the system, because it permits residual fluid pressure to remain within the cylinder after the balls are retracted. It is therefore not necessary to completely open the manifold system and "exhaust" fluid therefrom, but only to allow pressure to "bleed" from the system and close the valve or valves at an opportune and desired time. Thus, when re-pressuring the system, operational pressures adequate to extend the roller assembly can be brought up more quickly. Mainly, however, the wells or recesses in the piston crowns act as buffers; that is a pressure-biasing system, which is analogous to spring-loading the pistons to prevent sudden bottoming-out of the load produced, for example, when uneven deck surfaces and bumpy floors are traversed by the pallet or when the transporting aircraft or other vehicle undergoes vertical accelleration. Moreover, this feature permits system pressure to be selected such that when the load on any ball approaches its working limit, that ball and piston will be compressed into their respective cylinder and the load will be shared by adjacent or neighboring units. When loads due to acceleration are imposed on the pallet with the balls extended, the ball units are compressed substantially uniformly against their pressure-bias and the pallet settles to the deck thereby distributing the sudden load over substantially the entire bottom surface of the pallet. This action prevents the balls from denting the deck or cargo floor as might otherwise happen if the rollers were fixed in their extended position.

In a typical example of a pallet and retractable ball system according to the present invention, the "pitch" distance between flat top portions of adjacent corrugations is about 3.00 inches. When fully extended, the balls protrude beyond the flat bottom surface of the pallet about 0.300 inches. Each ball is about 1.00 inch in diameter and made from nylon. The cylinder diameter and height are normally about 1.5 inches. The centerline of a first in-board ball unit from the maximum extent of the side of the pallet structure is about 6.00 inches. The pistons are made of plastic and the pallet material is sheet metal. A core material having a density of about 5 pounds per cubic foot is used to fill the otherwise unoccupied space between the top and bottom pallet sheets and between adjacent closed cells or boxes which contain the ball units. A manifold header on each side of the pallet, parallel to the longitudinal axis thereof is connected with transversely extending manifold branches which run immediately underneath the pallet top sheet and are interconnected with the ball units in any given row thereof by suitable Tee fittings. Application of pneumatic fluid to a single fitting on the header therefore supplies pressure simultaneously to all manifold branches and, accordingly, to each and every ball unit cylinder. Likewise, removal or exhaustion of pneumatic fluid from the system through the single fitting on the header, simultaneously relieves pressure in all of the manifold branches and, accordingly, in each and every ball unit cylinder. As a consequence, operation of the retractable ball units of the disclosed pallet system is simple, quick and economical.

It will be appreciated by those skilled in the art that an improved cargo pallet achieving the above-mentioned and related objectives may be embodied in various forms within the framework of the inventive concepts. However, the illustrated embodiment is considered to be of optimum form and design so as to achieve these various objectives in a degree which is unique. Thus while the invention broadly embraces the concept of mounting a plurality of roller means in the lower surface of a cargo pallet which roller means are extendable and retractable in response to the imposition of pneumatic forces imposed upon the upper surface of the piston and cylinder means which carries the spherical roller, it will be appreciated that other well known pneumatic means for extending and retracting a piston element may be utilized. The construction and arrangement of elements may be varied to accomplish the stated objectives. It should also be noted that the extent to which the roller means protrudes from the bottom of the cargo pallet may vary in accordance with the surface incongruities to which the rolling pallet is subjected. These and other aspects of the invention including equivalents thereof will be apparent from an understanding of the subject matter as disclosed and as set forth in the claims which follow.

I claim:

1. A cargo pallet comprising: a substantially flat base including frame means for supporting cargo and for engaging a support surface, said frame means having an upper and lower surface;

a plurality of spaced-apart roller means disposed within said frame means, each roller means including an open-bottomed cylinder attached to said frame means, said cylinders being disposed within a corrugated intermediate member interengaging and supporting said upper and lower surface, and wherein each cylinder is at least partly retained in position by an upturned lip portion formed in said lower surface;

a piston having a lower skirt portion and being retained in a vertically reciprocal, fluid-tight relationship within each said cylinder;

a spherical roller rotatably retained within a semi-spherical chamber defined by said lower skirt portion of each said piston; and, pneumatic fluid distribution means interconnecting said cylinders, said fluid distribution means adapted to supply said cylinders with a source of pressurized pneumatic fluid; whereby pneumatic fluid is selectively supplied to and exhausted from all cylinders to reciprocate each piston between an upper, retracted position in which each said spherical roller is contained within said pallet base and a lower, extended position in which at least a portion of each said spherical roller protrudes through said lower surface.

2. A cargo pallet in accordance with claim 1 wherein said piston is retained within said cylinder by a retaining plate attached to said lower surface, said retaining plate defining an aperture having a diameter greater than the diameter of said spherical roller but smaller than that of said piston.

3. A cargo pallet in accordance with claim 1 wherein said spherical roller is retained within said semi-spherical chamber by an annular retaining ring engaging said lower skirt portion of said piston.

4. The apparatus of claim 1 wherein a portion of the surface of said spherical roller within said chamber is disposed in rolling contact with the surfaces of a plurality of ball-bearings carried within a recess formed in said chamber.

5. A cargo pallet in accordance with claim 1 wherein said fluid distribution means is interconnected to said cylinders by manifold means whereby all said cylinders are pneumatically interconnected and are pressurized simultaneously by said source of pneumatic fluid.

6. A cargo pallet in accordance with claim 1 wherein spaces within the pallet base are filled with relatively light weight, incompressible filler material selected from the group consisting of foam plastic, balsa wood, cellular honeycomb paper and plastic whereby said filler material enhances said substantially rigid spaced-apart relationship of said upper and lower sheet members and, accordingly the rigidity of said pallet base.

7. A cargo pallet in accordance with claim 6 wherein said filler material has a density of about 5 pounds per cubic foot.

8. A cargo pallet comprising a flat, substantially rectangular base having a thickness considerably less than its length or width and including an imperforate upper sheet member, an apertured lower sheet member and at least one corrugated intermediate member joining said upper and lower sheet members and maintaining said members in a substantially rigid, spaced-apart relationship; a plurality of spaced-apart individual and independent roller means contained within a corresponding plurality of cells formed by portions of said corrugated member and arranged in a predetermined pattern disposed adjacent said lower sheet member, each roller means including a normally open-bottomed cylinder attached to said lower sheet member, a piston having an upper crown portion and a lower skirt portion, said piston being retained in a vertically reciprocal, fluid-tight relationship within said cylinder, and a spherical roller rotatably retained within a semi-spherical chamber defined by the lower skirt portion of said piston, each of said cells containing a cylinder including sidewall and end wall portions formed by a single corrugation of said corrugated intermediate member, each cylinder being at least partly retained in position by an up-turned lip portion formed in said lower sheet member; pneumatic fluid distribution means including conduits connecting all cylinders with each other and to a manifold, said manifold intermittently connecting said conduits and, thereby, said cylinders with a source of pneumatic fluid; whereby pneumatic fluid is selectively supplied to and exhausted from all cylinders to reciprocate each piston between an upper, retracted position in which each said spherical roller is totally contained within said pallet base and, alternatively, a lower, extended position in which at least a portion of each said spherical roller protrudes through a corresponding aperture in said lower sheet member of the pallet base.

9. A cargo pallet in accordance with claim 8 wherein said piston is retained within said cylinder by an apertured retaining plate attached to the apertured lower sheet member of said pallet base, the apertures in said retaining plate having a diameter larger than that of said spherical roller but less than that of said piston.

10. A cargo pallet in accordance with claim 9 wherein said spherical roller is retained within said semi-spherical chamber by an externally threaded annular retaining ring whose threads are complemental with internal threads formed in the lower skirt portion of said piston, and wherein a portion of the surface of said spherical roller within said chamber is disposed in rolling contact with surfaces of a plurality of ball bearings carried within a recess formed in an upper wall portion of said chamber.

11. A cargo pallet in accordance with claim 10 wherein said spherical roller is made of nylon, said piston and said retaining ring are made of plastic and said cylinders, said corrugated member and said pallet upper and lower sheet members are made of sheet metal.

12. A cargo pallet in accordance with claim 8 wherein any unfilled or unoccupied spaces within the pallet base are filled with relatively lightweight, incompressible filler material selected from the group consisting of foam plastic, balsa wood, cellular honeycomb paper and plastic, whereby said filler material enhances said substantially rigid, spaced-apart relationship of said upper and lower sheet members and, accordingly, the rigidity of said pallet base.

* * * * *